US009694466B2

(12) United States Patent
Muroya et al.

(10) Patent No.: US 9,694,466 B2
(45) Date of Patent: Jul. 4, 2017

(54) LENS PROCESSING APPARATUS AND METHOD FOR LENS PROCESSING

(71) Applicant: OLYMPUS CORPORATION, Shibuya-ku, Tokyo (JP)

(72) Inventors: Shingo Muroya, Hachioji (JP); Satoshi Kawarabata, Machida (JP)

(73) Assignee: OLYMPUS CORPORATION, Tokyo (JP)

( * ) Notice: Subject to any disclaimer, the term of this patent is extended or adjusted under 35 U.S.C. 154(b) by 0 days.

(21) Appl. No.: 14/878,493

(22) Filed: Oct. 8, 2015

(65) Prior Publication Data

US 2016/0023319 A1 Jan. 28, 2016

Related U.S. Application Data

(63) Continuation of application No. PCT/JP2014/062351, filed on May 8, 2014.

(30) Foreign Application Priority Data

Sep. 27, 2013 (JP) ..... 2013-202391

(51) Int. Cl.
*B24B 13/06* (2006.01)
*B24B 49/10* (2006.01)
*B24B 9/14* (2006.01)

(52) U.S. Cl.
CPC ..... *B24B 13/06* (2013.01); *B24B 9/14* (2013.01)

(58) Field of Classification Search
CPC ..... B24B 13/06; B24B 49/10
USPC ..... 451/42, 43, 255, 256, 5
See application file for complete search history.

(56) References Cited

U.S. PATENT DOCUMENTS 5,149,337 A * 9/1992 Watanabe ..... B24B 13/00 451/255
7,614,742 B2 11/2009 Mandler et al.

FOREIGN PATENT DOCUMENTS

| | | | |
|---|---|---|---|
| JP | 49135895 | U | 11/1974 |
| JP | 02109671 | A | 4/1990 |
| JP | 2005125453 | A | 5/2005 |
| JP | 2005219183 | A | 8/2005 |
| JP | 2012240178 | A | 12/2012 |

OTHER PUBLICATIONS

International Search Report (ISR) dated Jul. 15, 2014 issued in International Application No. PCT/JP2014/062351.

* cited by examiner

*Primary Examiner* — Robert Rose
(74) *Attorney, Agent, or Firm* — Holtz, Holtz & Volek PC

(57) ABSTRACT

A method for lens processing includes the steps of: holding an optical member as a processing target such that an optical axis of the optical member is orthogonal to a central axis of a ring-shaped grinding tool; and grinding the optical member by causing the optical member to abut on an end face of the grinding tool while rotating at least the grinding tool around the central axis. The grinding of the optical member includes causing at least one of the optical member and the grinding tool to move relatively to the other along the optical axis while rotating only the grinding tool to grind a part of an outer periphery of the optical member in a planar shape.

4 Claims, 12 Drawing Sheets

LENS PROCESSING APPARATUS AND METHOD FOR LENS PROCESSING

CROSS REFERENCES TO RELATED APPLICATIONS

This application is a continuation of PCT international application Ser. No. PCT/JP2014/062351 filed on May 8, 2014 which designates the United States, incorporated herein by reference, and which claims the benefit of priority from Japanese Patent Application No. 2013-202391, filed on Sep. 27, 2013, incorporated herein by reference.

BACKGROUND

1. Technical Field

The disclosure relates to a lens processing apparatus and a method for lens processing to grind an optical member.

2. Related Art

In a lens manufacturing process, after an optical surface of a lens is formed and polished, centering and edging processing is performed in which an outer periphery of the lens is ground and finished in a predetermined size such that an optical axis of the lens coincides with a central axis of an outer diameter of the lens. After the centering and edging processing, chamfering and end face processing are performed as necessary. Furthermore, depending on an apparatus in which the lens is incorporated, so-called D-cut processing in which a part of the outer periphery of the lens is finished in a planar shape may be performed.

There has been known a technique for performing a plurality of processing steps by the same apparatus. For example, Japanese Patent Application Laid-open No. 2005-125453 discloses a technique for successively performing the centering and edging processing and the D-cut processing by a centering and edging apparatus of a bell-clamp type in which a lens is sandwiched by a pair of lens holders arranged to face each other and by controlling a relationship between a rotation angle of a workpiece axis and a position of a grindstone. Japanese Patent Application Laid-open No. 2005-219183 discloses a lens centering and edging processing apparatus including a lens holding axis attached with a lens fixture that holds the lens, a first grinding wheel spindle rotatable around an axis parallel to a rotation axis of the lens holding axis, and a second grinding wheel spindle rotatable around an axis orthogonal to the rotation axis of the lens holding axis. The centering and edging processing is performed by a grindstone attached to the first grinding wheel spindle, and the end face processing is performed by a grindstone attached to the second grinding wheel spindle.

SUMMARY

In some embodiments, a lens processing apparatus includes: an optical member holding unit configured to hold an optical member as a processing target, the optical member holding unit being rotatable around a first rotation axis; a first driving unit configured to rotate the optical member holding unit; a ring-shaped grinding tool; a grinding tool holding unit configured to coaxially hold the grinding tool, the grinding tool holding unit being rotatable around a second rotation axis orthogonal to the first rotation axis; a second driving unit configured to rotate the grinding tool holding unit; a moving unit configured to move at least one of the optical member and the grinding tool relatively to the other; and a control unit configured to control relative movement between the optical member and the grinding tool by the moving unit and rotation of the optical member and the grinding tool by the first and second driving units. The control unit is configured to cause at least one of the optical member and the grinding tool to move relatively to the other along the first rotation axis and to cause an outer periphery of the optical member to abut on an end face of the grinding tool while rotating only the grinding tool to grind a part of the outer periphery in a planar shape.

In some embodiments, a lens processing apparatus includes: an optical member holding unit configured to hold an optical member as a processing target, the optical member holding unit being rotatable around a first rotation axis; a first driving unit configured to rotate the optical member holding unit; a ring-shaped grinding tool; a grinding tool holding unit configured to coaxially hold the grinding tool, the grinding tool holding unit being rotatable around a second rotation axis orthogonal to the first rotation axis; a second driving unit configured to rotate the grinding tool holding unit; a moving unit configured to move at least one of the optical member and the grinding tool relatively to the other; and a control unit configured to control relative movement between the optical member and the grinding tool by the moving unit and rotation of the optical member and the grinding tool by the first and second driving units. The control unit is configured to cause an outer periphery of the optical member to abut on an end face of the grinding tool and to cause at least one of the optical member and the grinding tool to move relatively to the other along the second rotation axis while rotating only the grinding tool to grind a part of the outer periphery in a planar shape.

In some embodiments, a method for lens processing includes the steps of: holding an optical member as a processing target such that an optical axis of the optical member is orthogonal to a central axis of a ring-shaped grinding tool; and grinding the optical member by causing the optical member to abut on an end face of the grinding tool while rotating at least the grinding tool around the central axis. The grinding of the optical member includes causing at least one of the optical member and the grinding tool to move relatively to the other along the optical axis while rotating only the grinding tool to grind a part of an outer periphery of the optical member in a planar shape.

In some embodiments, a method for lens processing includes the steps of: holding an optical member as a processing target such that an optical axis of the optical member is orthogonal to a central axis of a ring-shaped grinding tool; and grinding the optical member by causing the optical member to abut on an end face of the grinding tool while rotating at least the grinding tool around the central axis. The grinding of the optical member includes causing an outer periphery of the optical member to abut on the end face of the grinding tool and causing at least one of the optical member and the grinding tool to move relatively to the other along the central axis while rotating only the grinding tool to grind a part of the outer periphery in a planar shape.

The above and other features, advantages and technical and industrial significance of this invention will be better understood by reading the following detailed description of presently preferred embodiments of the invention, when considered in connection with the accompanying drawings.

DETAILED DESCRIPTION

Exemplary embodiments of a lens processing apparatus and a method for lens processing according to the present invention will be described below with reference to the drawings. The present invention is not to be limited by these embodiments. The same reference signs are used to designate the same elements throughout the drawings. The drawings are schematic, whereby it is necessary to be aware that a dimensional relation and ratio between each of the parts may be different from actualities. Between the drawings as well, there may be parts having the dimensional relation and ratio between each of the parts that are different.

First Embodiment

Figure 1:
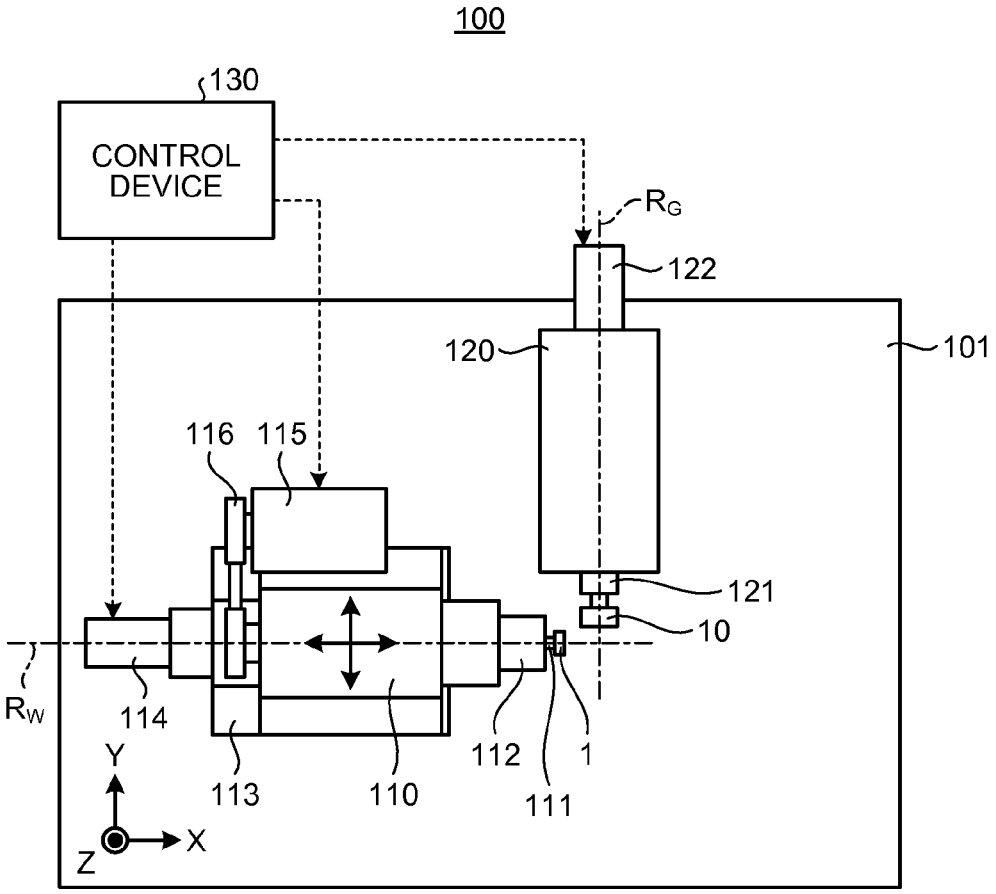
FIG. 1 is a schematic diagram illustrating a configuration of a lens processing apparatus according to a first embodiment of the present invention.

FIG. 1 is a schematic diagram illustrating a configuration of a lens processing apparatus according to a first embodiment of the present invention.

As illustrated in FIG. 1, a lens processing apparatus 100 according to the first embodiment includes: a workpiece shaft 110 as a rotatable optical member holding unit that holds an optical member (workpiece) 1 as a processing target, a workpiece holding tool 111, a workpiece holding mechanism 112, a workpiece shaft moving mechanism 113 and a drive motor 114 that move the workpiece shaft 110, a rotation motor 115 and a rotation transmission mechanism 116 that rotate the workpiece shaft 110, a grinding tool 10 that grinds the workpiece 1, a grinding wheel spindle 120 and a flange 121 as grinding tool holding units that rotatably hold the grinding tool 10, and a rotation motor 122 that rotates the grinding wheel spindle 120. Each of the parts is disposed on a base 101. The lens processing apparatus 100 is also provided with a control device 130 that controls operation of each of the parts. Hereinafter, an upper surface of the base 101 is referred to as an XY surface, and a direction orthogonal to the XY surface is referred to as a Z direction.

The workpiece shaft 110 is a rotatable spindle that holds the workpiece 1, and is disposed on the workpiece shaft moving mechanism 113 along an X direction. The workpiece holding tool 111 is provided at a tip of the workpiece shaft 110, and it holds the workpiece 1 through an adhesive. The workpiece holding mechanism 112 fixes the workpiece holding tool 111 to the workpiece shaft 110. Note that a means for holding the workpiece 1 is not limited to the adhesive. For example, it is also possible to fix the workpiece 1 to the workpiece shaft 110 by using a vacuum suction mechanism.

The workpiece shaft moving mechanism 113 is disposed directly on the base 101, and is a means for moving the workpiece shaft 110 parallel within the XY surface by a driving force of the drive motor 114. Accordingly, a relative position of the workpiece 1 to the grinding tool 10 is controlled.

The rotation transmission mechanism 116 includes a pulley and a belt for transmitting a rotary driving force of the rotation motor 115 to the workpiece shaft 110. By operating the rotation motor 115, the workpiece shaft 110 rotates around a rotation axis $R_W$.

The grinding wheel spindle 120 is a rotatable spindle holding the grinding tool 10, and is disposed along a Y direction. That is, a rotation axis $R_G$ of the grinding wheel spindle 120 is orthogonal to the rotation axis $R_W$ of the workpiece shaft 110. The flange 121 is provided at a tip of the grinding wheel spindle 120, and it holds the grinding tool 10 such that the grinding tool 10 and the grinding wheel spindle 120 are coaxial. The rotation motor 122 rotates the grinding wheel spindle 120 around the rotation axis $R_G$.

Figure 2:
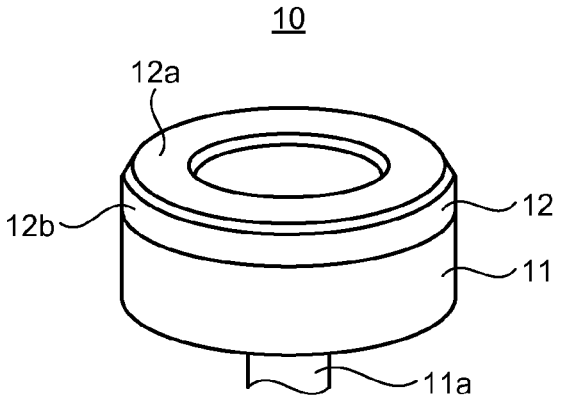
FIG. 2 is an enlarged perspective view illustrating a grinding tool of FIG. 1.

FIG. 2 is an enlarged perspective view illustrating the grinding tool 10 of FIG. 1. As illustrated in FIG. 2, the grinding tool 10 includes a cup with shaft 11 and a grindstone 12 provided to an end portion of the cup with shaft 11.

The cup with shaft 11 is a metal or alloy jig having a cup shape, which is a cylinder with one end face thereof being sealed. By attaching a shaft portion 11*a*, which is provided at a rotation center on a bottom face side of the cup, to the flange 121 (see FIG. 1), the grinding tool 10 is fixed to the grinding wheel spindle 120.

The grindstone 12 has a ring shape with a center portion of a column being hollowed out, and includes an annular planar grinding surface 12*a*, which is an end face of the grindstone 12, and an outer periphery grinding surface 12*b*, which is an outer periphery of the grindstone 12. Chamfering is performed on a region where the end face of the grindstone 12 crosses with each of the outer periphery and an inner periphery surface.

The control device 130, for example, is achieved by a general-purpose computer such as a personal computer, and controls each part of the lens processing apparatus 100 by reading a predetermined control program by hardware such as a CPU. Specifically, the control device 130 adjusts a relative positional relationship between the workpiece shaft 110 and the grinding wheel spindle 120 by controlling operation of the drive motor 114, the rotation motor 115, and the rotation motor 122. By rotating each of the workpiece shaft 110 and the grinding wheel spindle 120 at a rotation speed set in advance, the control device 130 causes each of the parts of the lens processing apparatus 100 to perform a series of lens manufacturing work by processing the workpiece 1.

Figure 3:
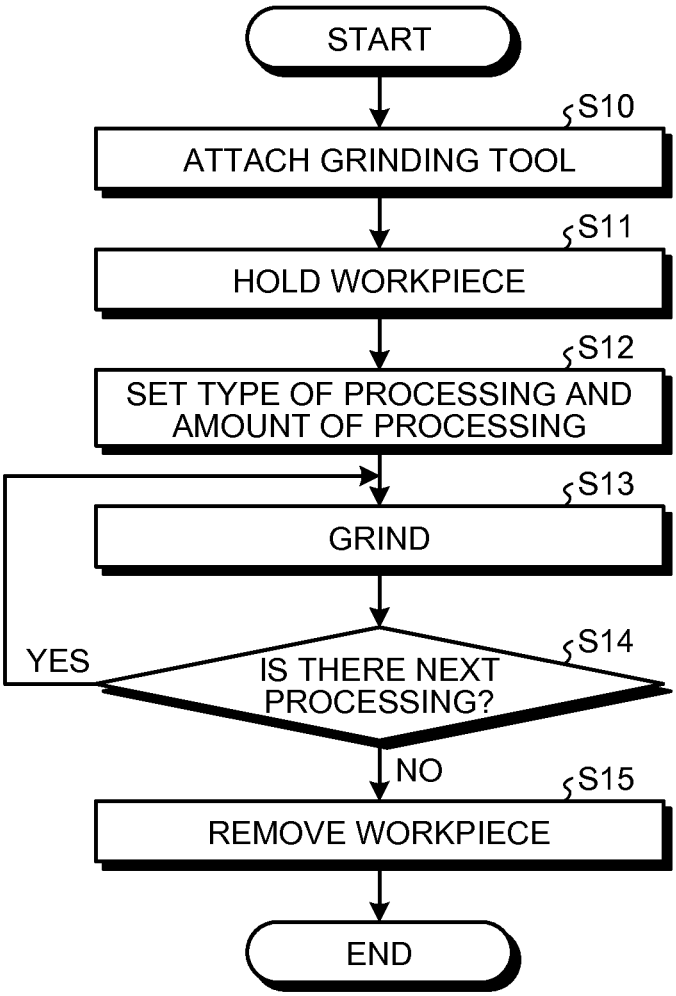
FIG. 3 is a flowchart illustrating a method for lens processing according to the first embodiment of the present invention.
Figure 4A:
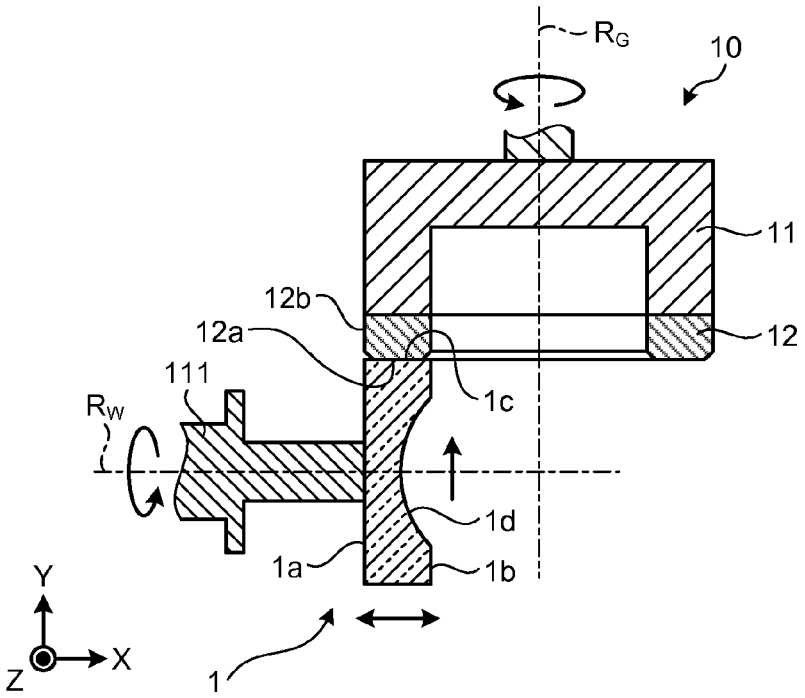
FIG. 4A is an XY sectional view illustrating a centering and edging processing step in the method for lens processing according to the first embodiment of the present invention.
Figure 4B:
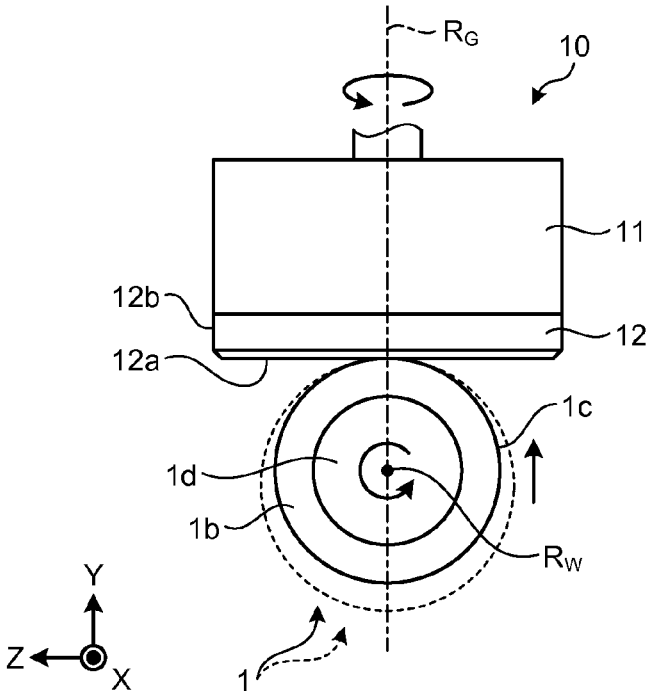
FIG. 4B is a YZ sectional view illustrating the centering and edging processing step in the method for lens processing according to the first embodiment of the present invention.
Figure 5A:
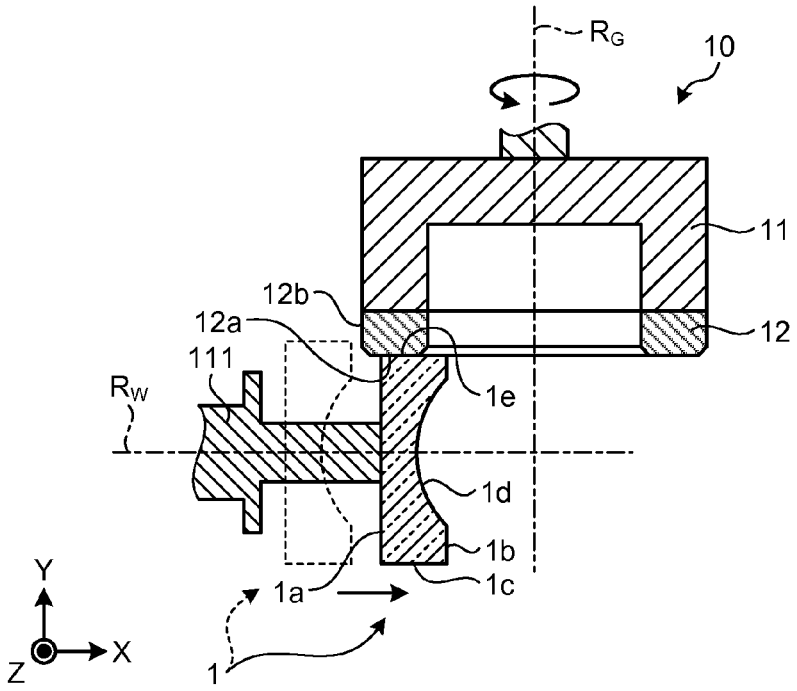
FIG. 5A is an XY sectional view illustrating a D-cut processing step in the method for lens processing according to the first embodiment of the present invention.
Figure 5B:
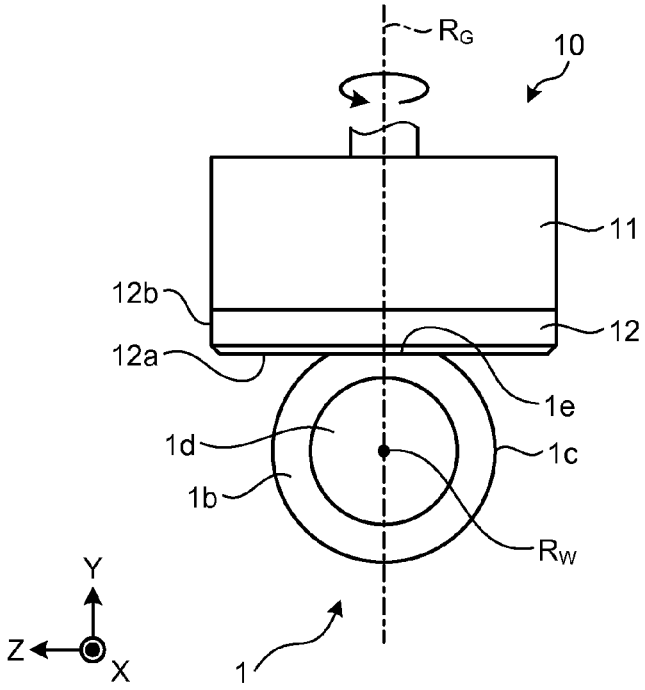
FIG. 5B is a YZ sectional view illustrating the D-cut processing step in the method for lens processing according to the first embodiment of the present invention.

Next, the method for lens processing according to the first embodiment will be described with reference to FIG. 1 and FIGS. 3 to 5B. FIG. 3 is a flowchart illustrating the method for lens processing according to the first embodiment. FIG. 4A is an XY sectional view illustrating a centering and edging processing (outer periphery processing) step of the method for lens processing, and FIG. 4B is an YZ planar view of the same. FIG. 5A is an XY sectional view illustrating a D-cut processing step of the method for lens processing, and FIG. 5B is an YZ planar view of the same. Reference will be made below to processing of an outer periphery 1*c* of the workpiece 1 having lens surfaces 1*a* and 1*b* on which desired surface forming and polishing have been performed. In FIGS. 4A to 5B, the planar lens surface 1*a* and the lens surface 1*b* having a recessed surface portion 1*d* at a center of a plane are shown; however, a shape of each of the lens surfaces 1*a* and 1*b* is not limited to this.

First, in step S10, the grinding tool 10 is attached to the flange 121.

In a subsequent step S11, alignment is made such that an optical axis of the workpiece 1 coincides with the rotation axis $R_W$ of the workpiece shaft 110, whereby the workpiece 1 is held by the workpiece holding tool 111. In the first embodiment, the workpiece 1 is fixed to the workpiece holding tool 111 with an adhesive.

In step S12, a type of processing and an amount of the processing performed on the workpiece 1 is set. Here, first, the centering and edging processing is performed in which the outer periphery 1*c* of the workpiece 1 is ground to obtain a desired outer diameter. Subsequently, the D-cut processing is performed in which a part of the outer periphery 1*c* is ground to form a plane. Thus, to the control device 130, a user inputs a target value for the outer diameter of the workpiece 1 and a coordinate value (distance from the optical axis) of a D-cut surface 1*e*. Note that in a case where the D-cut surfaces 1*e* are formed to multiple places of the workpiece 1, information related to positions and the number of the D-cut surfaces 1*e* is also input. According to a value and the information that are input, the control device 130 sets a coordinate value of the workpiece shaft 110 (or a relative coordinate value of the workpiece 1 to the grinding tool 10) at a start and an end of the processing. The control device 130 also sets a parameter such as a rotation speed of the workpiece shaft 110 and the grinding wheel spindle 120 and a moving speed of the workpiece shaft 110 in the X direction and the Y direction. Note that these parameters may also be automatically set by the control device 130 or be manually input by the user.

In subsequent step S13, the control device 130 grinds the workpiece 1 by causing each of the parts of the lens processing apparatus 100 to start operation. As illustrated in FIGS. 4A and 4B, in a case where the centering and edging processing is performed on the workpiece 1, the rotation motors 115 and 122 are driven, and the outer periphery 1*c* of the rotating workpiece 1 is abutted on the planar grinding surface 12*a* of the rotating grinding tool 10 (see a broken line in FIG. 4B). Then, by moving the workpiece 1 in a positive Y direction while swinging it along the X direction, the outer periphery 1*c* of the workpiece 1 is uniformly ground by the planar grinding surface 12*a*.

When the coordinate value of the workpiece shaft 110 reaches the coordinate value set in the step S12, the control device 130 separates the outer periphery 1*c* of the workpiece 1 from the planar grinding surface 12*a*, and causes each of the parts of the lens processing apparatus 100 to stop the operation. Accordingly, it is possible to obtain the workpiece 1 having the outer periphery being ground until the desired diameter is reached.

In subsequent step S14, the control device 130 determines whether or not there is next processing to be performed on the workpiece 1. As described above, since the D-cut processing is performed after the centering and edging processing here (Yes in step S14), the operation of the lens processing apparatus 100 returns to the step S13.

In the step S13, the control device 130 causes each of the parts of the lens processing apparatus 100 to start the operation and performs grinding of the workpiece 1. As illustrated in FIGS. 5A and 5B, in a case where the D-cut processing is performed on the workpiece 1, the workpiece 1 (see the broken line) is arranged outside of the outer periphery grinding surface 12*b* of the grinding tool 10, and coordinates of the workpiece shaft 110 is adjusted such that a Y coordinate of the D-cut surface 1*e* formed on the workpiece 1 coincides with a Y coordinate of the planar grinding surface 12*a*. Then, while an angle of the workpiece 1 around the rotation axis $R_W$ is fixed, only the grinding tool 10 is rotated by driving the rotation motor 122. In this state, by moving the workpiece 1 in a positive X direction, and by grinding the workpiece 1 by the outer periphery grinding surface 12*b* along the rotation axis $R_W$, the planar D-cut surface 1*e* is formed as well as the D-cut surface 1*e* is further planarized by the planar grinding surface 12*a*.

Once the workpiece 1 passes through the planar grinding surface 12*a* completely, the control device 130 causes each of the parts of the lens processing apparatus 100 to stop the operation. Note that in a case where a grinding amount of the workpiece 1 is large, it is possible to form the D-cut surface 1*e* in multiple times while shifting the Y coordinate of the workpiece shaft 110.

In addition, in a case where the D-cut surfaces 1*e* are formed to multiple places of the outer periphery 1*c*, subsequently, the workpiece 1 is brought back to a position outside the outer periphery grinding surface 12*b*. After the workpiece 1 is rotated a predetermined angle (for example, 180 degrees) around the rotation axis $R_W$, the grinding tool 10 is rotated again, whereby the workpiece 1 may be ground by the outer periphery grinding surface 12*b*.

Figure 6:
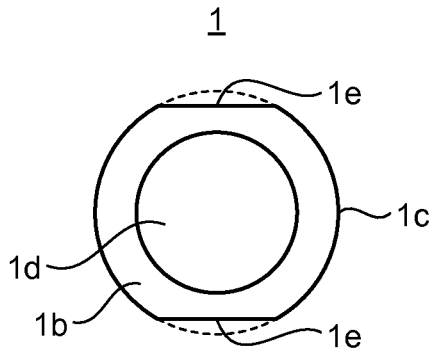
FIG. 6 is a planar view illustrating a workpiece on which centering and edging processing and D-cut processing have been performed.

In the step S14, in a case where all of the processing set for the workpiece 1 is completed (NO in step S14), the workpiece 1 is removed from the workpiece holding tool 111 in subsequent step S15. Accordingly, as illustrated in FIG. 6, it is possible to obtain the workpiece (lens) 1 on which the centering and edging processing and the D-cut processing have been performed. In FIG. 6, the two D-cut surfaces 1*e* are formed opposite to each other on the outer periphery 1*c*.

As described above, according to the first embodiment, the workpiece 1 and the grinding tool 10 are arranged such that the rotation axes $R_W$ and $R_G$ are orthogonal to each other, and the end face and the outer periphery of the grinding tool 10 are used as grinding surfaces in the processing, whereby it is possible to perform a plurality of processing steps by the lens processing apparatus 100 without complicating a structure of the apparatus. In addition, when the D-cut processing is performed, both of the planar grinding surface 12*a* of the grinding tool 10 and the D-cut surface 1*e* of the workpiece 1 abut on each other in a planar state, whereby misalignment of the angle of the D-cut surface 1*e* may be prevented. In addition, the workpiece 1 has only one rotation axis (only the rotation axis $R_W$), whereby angle control of the rotation axis $R_W$ becomes easier. Thus, it is possible to manufacture a lens, on which the highly-accurate centering and edging processing and the D-cut processing are performed, easily and within a short period of time.

Modification

Next, reference will be made to a modification of the first embodiment of the present invention.

Figure 7A:
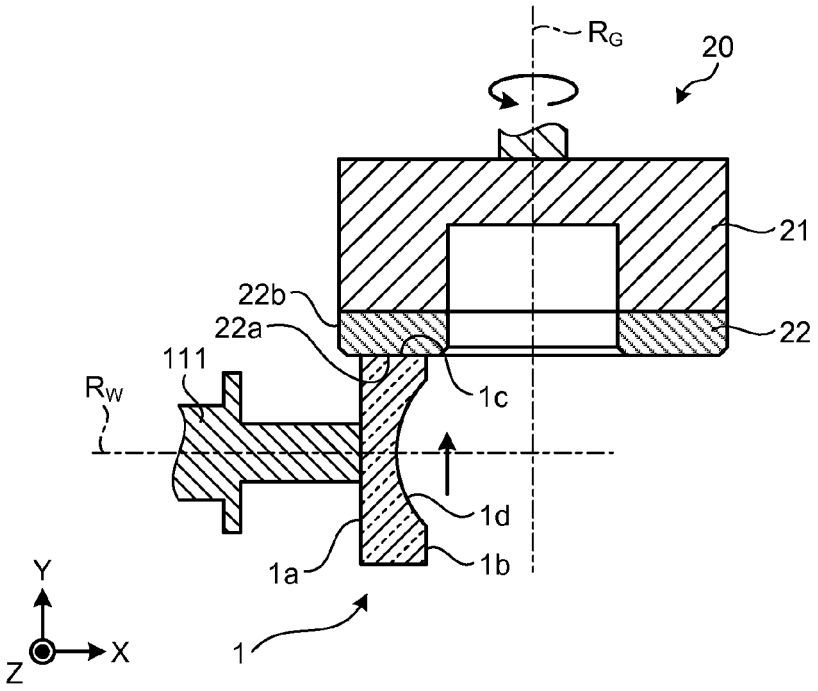
FIG. 7A is an XY sectional view illustrating a D-cut processing step of a workpiece according to a modification of the first embodiment of the present invention.
Figure 7B:
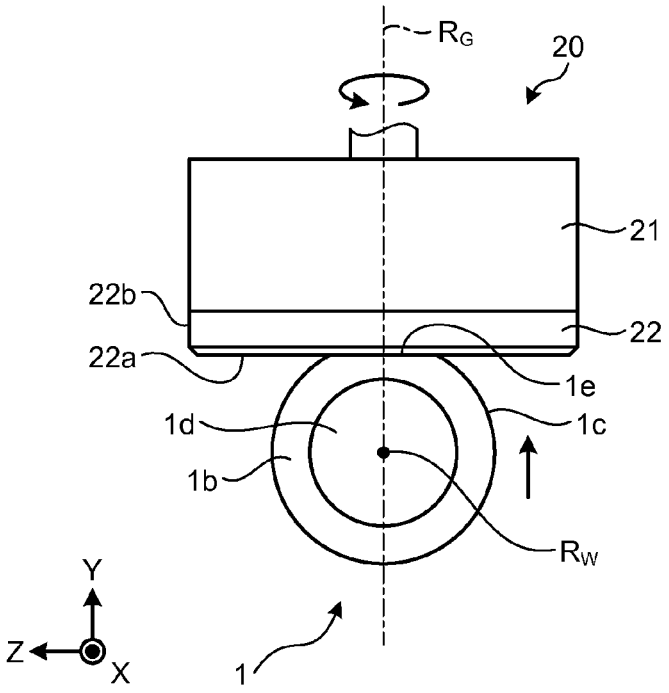
FIG. 7B is a YZ sectional view illustrating the D-cut processing step of the workpiece according to a modification of the first embodiment of the present invention.

FIG. 7A is an XY sectional view illustrating a D-cut processing step of a workpiece 1 according to the modification. FIG. 7B is an YZ planar view of the same. In the above-described first embodiment, in performing the D-cut processing, the grinding has been performed by moving the workpiece 1 in the direction orthogonal to the rotation axis $R_G$ of the grinding tool 10; however, in this modification, the grinding is performed by moving the workpiece 1 in a direction parallel to the rotation axis $R_G$ of the grinding tool 10. Note that the former is called creep feed grinding while the latter is called infeed grinding.

As illustrated in FIGS. 7A and 7B, in this modification, a grinding tool 20 provided with a cup with shaft 21 and a ring-shaped grindstone 22 is used. In the same way as the grinding tool 10 of the first embodiment, the grinding tool 20 has an annular planar grinding surface 22*a*, which is an end face of the grindstone 22, and an outer periphery grinding surface 22*b*. Among these, a length in a radial direction of the planar grinding surface 22*a* is longer than a length in an optical axis direction of the outer periphery 1*c* of the workpiece 1.

When performing the D-cut processing, while an angle of the workpiece 1 around the rotation axis $R_W$ is fixed, only the grinding tool 20 is rotated, and the outer periphery 1*c* of the workpiece 1 is abutted on the planar grinding surface 22*a*. Then, the workpiece 1 is moved in the positive Y direction, and a part of the outer periphery 1*c* of the workpiece 1 is ground by the planar grinding surface 22*a* along the rotation axis $R_G$ of the grinding tool 20. At this time, it is also possible to swing the workpiece shaft 110 in the X direction. Accordingly, the planar D-cut surface 1*e* is formed.

Second Embodiment

Next, reference will be made to a second embodiment of the present invention.

Figure 8A:
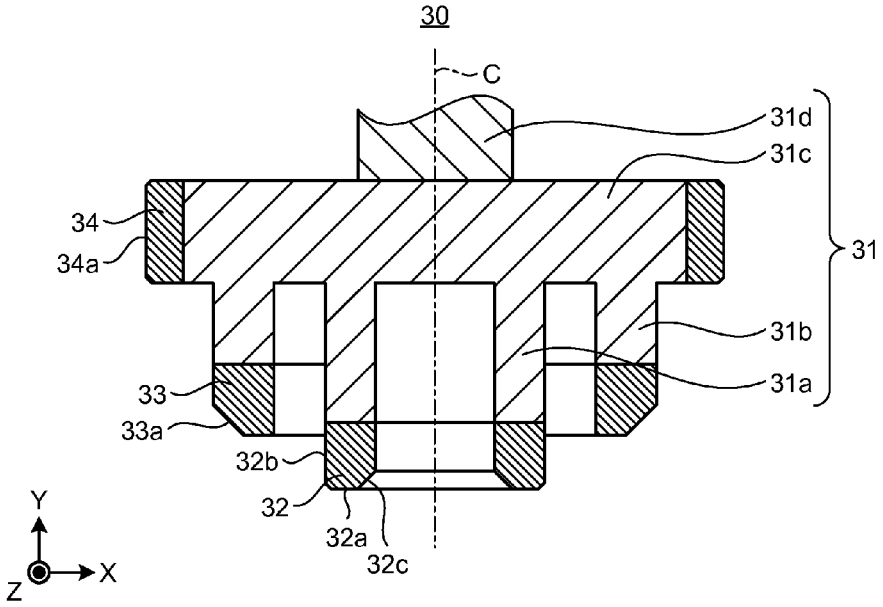
FIG. 8A is an XY sectional view illustrating a grinding tool used in a lens processing apparatus according to a second embodiment of the present invention.
Figure 8B:
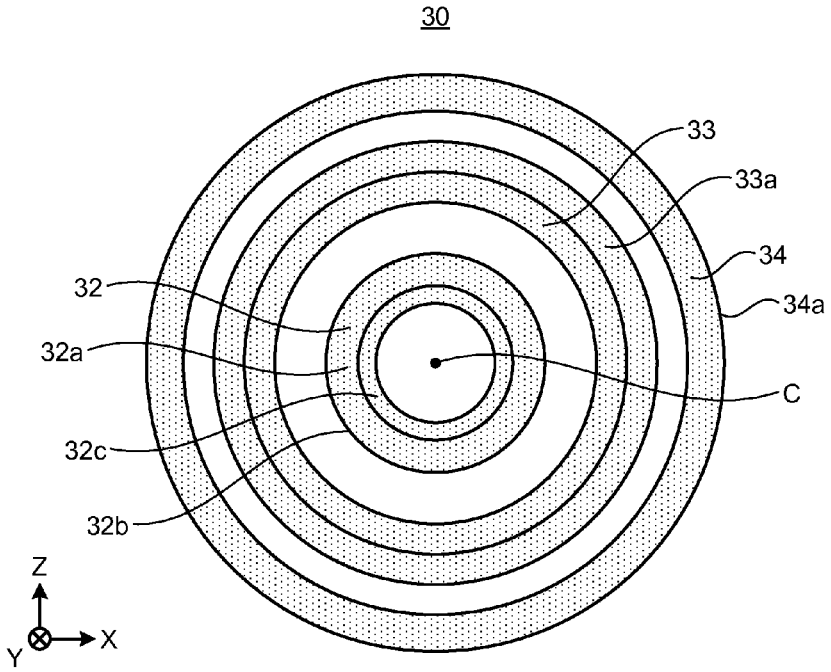
FIG. 8B is an XZ sectional view illustrating the grinding tool used in the lens processing apparatus according to the second embodiment of the present invention.

FIG. 8A is an XY sectional view illustrating a grinding tool used in a lens processing apparatus according to the second embodiment of the present invention, and FIG. 8B is an XZ planar view of the same. Note that an overall configuration of the lens processing apparatus according to the second embodiment is the same as that illustrated in FIG. 1; however, in place of the grinding tool 10 illustrated in FIG. 1, a grinding tool 30 illustrated in FIGS. 8A and 8B is used.

The grinding tool 30 includes a cup with shaft 31 and grindstones 32, 33, and 34 each provided to an end portion of the cup with shaft 31.

The cup with shaft 31 is a metal or alloy jig including a first cylindrical portion 31*a*, a second cylindrical portion 31*b*, a discoidal portion 31*c*, and a shaft portion 31*d* that are concentrically provided. Among these, height of the first cylindrical portion 31*a* is higher than that of the second cylindrical portion 31*b*.

At an end portion of the first cylindrical portion 31*a*, the ring-shaped grindstone 32 is provided. The grindstone 32 has an annular planar grinding surface 32*a*, which is an end portion of the grindstone 32, an outer periphery grinding surface 32*b*, which is an outer periphery of the grindstone 32, and an inclined grinding surface 32*c* provided at an angle of 45 degrees on an inner periphery side of the planar grinding surface 32*a*. Chamfering is performed on a region where the planar grinding surface 32*a* crosses the outer periphery grinding surface 32*b*.

At an end portion of the second cylindrical portion 31*b*, the ring-shaped grindstone 33 is provided. The grindstone 33 has an inclined grinding surface 33*a* provided at an angle of 45 degrees on an outer periphery side of an end face.

On an outer periphery of the discoidal portion 31*c*, the ring-shaped grindstone 34 is provided. The grindstone 34 has an outer periphery grinding surface 34*a*, which is an outer periphery of the grindstone 34. Chamfering is performed on a region where the outer periphery grinding surface 34*a* crosses each of upper and lower surfaces.

Length in a radial direction and length in a direction of central axis C of the first cylindrical portion 31*a*, the second cylindrical portion 31*b*, and the discoidal portion 31*c* as well as the grindstones 32, 33, and 34 provided to each of these portions are set such that, when each of the grindstones 32, 33, and 34 is used, an unused grindstone does not contact with a workpiece. Specifically, the grindstone 32 is protruded more than the grindstone 33 such that the workpiece does not contact with the grindstone 33 when grinding is performed by the outer periphery grinding surface 32*b*. In addition, in order to prevent contact between the workpiece and the grindstone 32 when the grinding is performed by the inclined grinding surface 33*a*, a radius of the grindstone 33 is set such that the grindstone 32 does not protrude from an extended surface of the inclined grinding surface 33*a*. Furthermore, such that the workpiece does not contact with the grindstone 33 when the grinding is performed on the outer periphery grinding surface 34*a*, a radius of the grindstone 34 is made to be larger than the radius of the grindstone 33.

Note that a type of abrasive grain used by the grindstones 32, 33, and 34 may all be the same or may be different. In FIG. 8B, illustration of the chamfering performed on each of the grindstones 32, 33, and 34 is omitted.

A method for lens processing using the grinding tool 30 is the same as a whole as that in FIG. 3; however, an individual processing step performed in the step S13 is different. Hereinafter, a variety of processing steps performed in the step S13 are described with reference to FIGS. 9 to 13.

Figure 9:
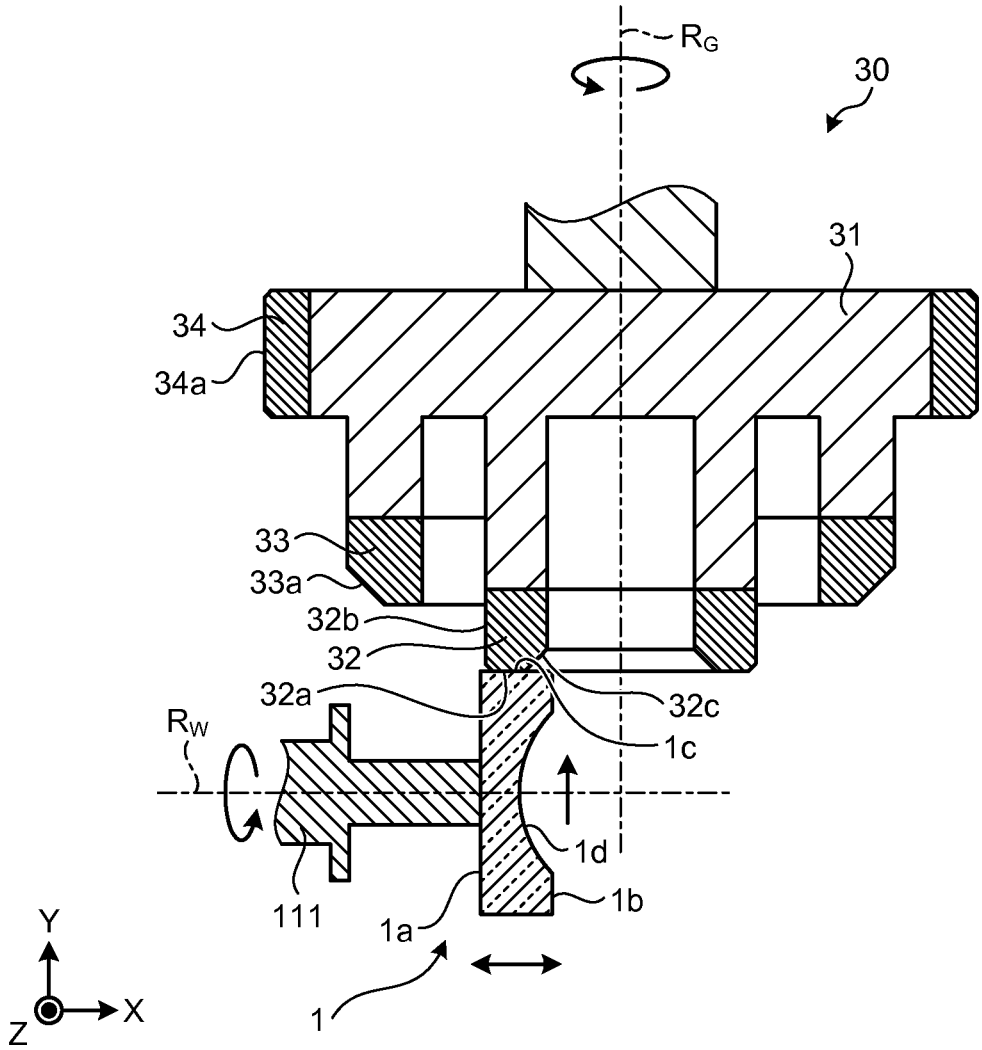
FIG. 9 is an XY sectional view illustrating a centering and edging processing step in the method for lens processing according to the second embodiment of the present invention.

FIG. 9 is an XY sectional view illustrating centering and edging processing performed on a workpiece 1. As illustrated in FIG. 9, in a case where the centering and edging processing is performed, the workpiece 1 and the grinding tool 30 are rotated by driving rotation motors 115 and 122 (see FIG. 1), and an outer periphery 1*c* of the workpiece 1 is abutted on the planar grinding surface 32*a*. Then, by moving the workpiece 1 in a positive Y direction while swinging it along an X direction, the outer periphery 1*c* of the workpiece 1 is uniformly ground by the planar grinding surface 32*a*.

Figure 10:
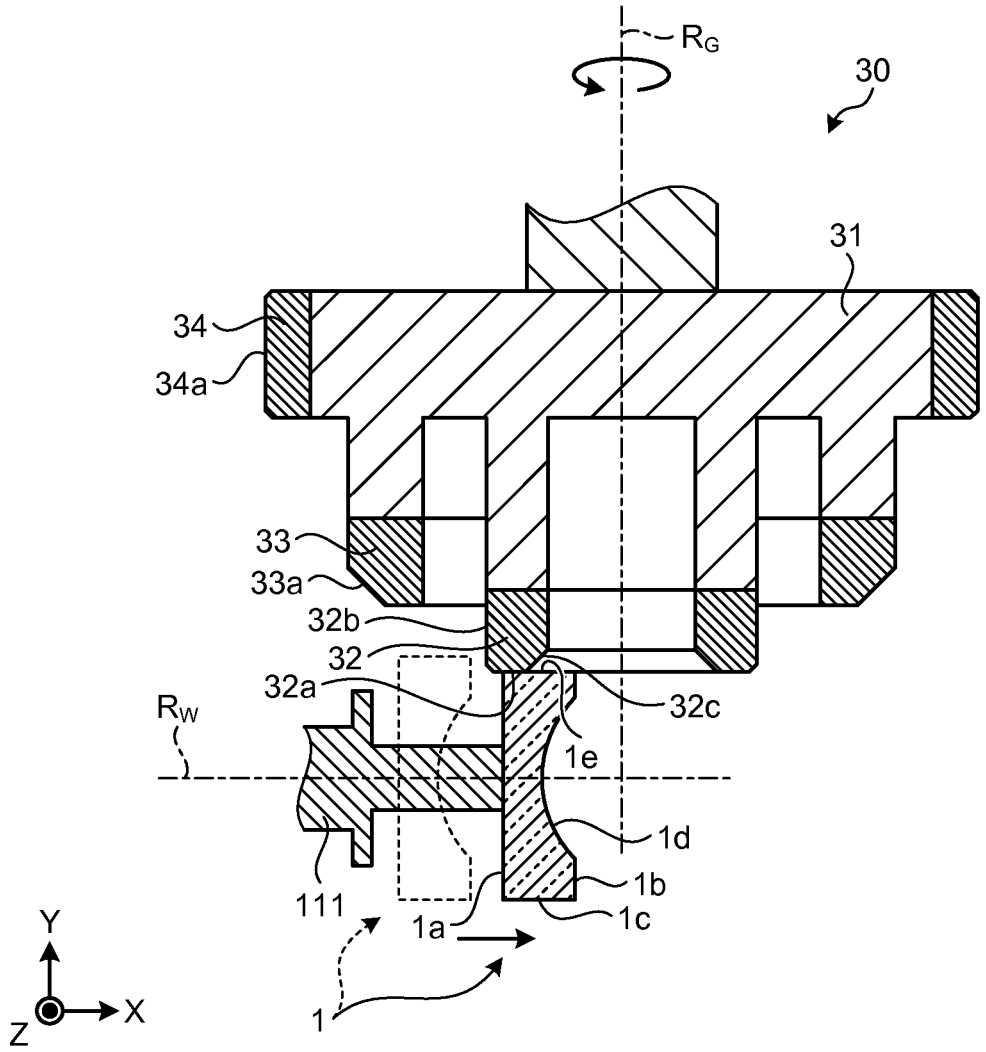
FIG. 10 is an XY sectional view illustrating a D-cut processing step in the method for lens processing according to the second embodiment of the present invention.

FIG. 10 is the XY sectional view illustrating D-cut processing performed on the workpiece 1. As illustrated in FIG. 10, in a case where the D-cut processing is performed, the workpiece 1 (see a broken line) is arranged outside of the outer periphery grinding surface 32*b* of the grinding tool 30, and a coordinate of a workpiece shaft 110 is adjusted such that a Y coordinate of a D-cut surface 1*e* formed in the workpiece 1 coincides with a Y coordinate of the planar grinding surface 32*a*. Then, while an angle of the workpiece 1 around a rotation axis $R_W$ is fixed, only the grinding tool 30 is rotated by driving the rotation motor 122. In this state, the workpiece 1 is moved in a positive X direction, and by grinding the workpiece 1 along the rotation axis $R_W$ by the outer periphery grinding surface 32*b*, the planar D-cut surface 1*e* is formed as well as the D-cut surface 1*e* is further planarized by the planar grinding surface 32*a*.

In a case where the D-cut processing is performed, in the same way as the modification of the first embodiment, it is also possible to perform the grinding by the planar grinding surface 32*a* by moving the workpiece 1 along a rotation axis $R_G$ of the grinding tool 30.

Figure 11:
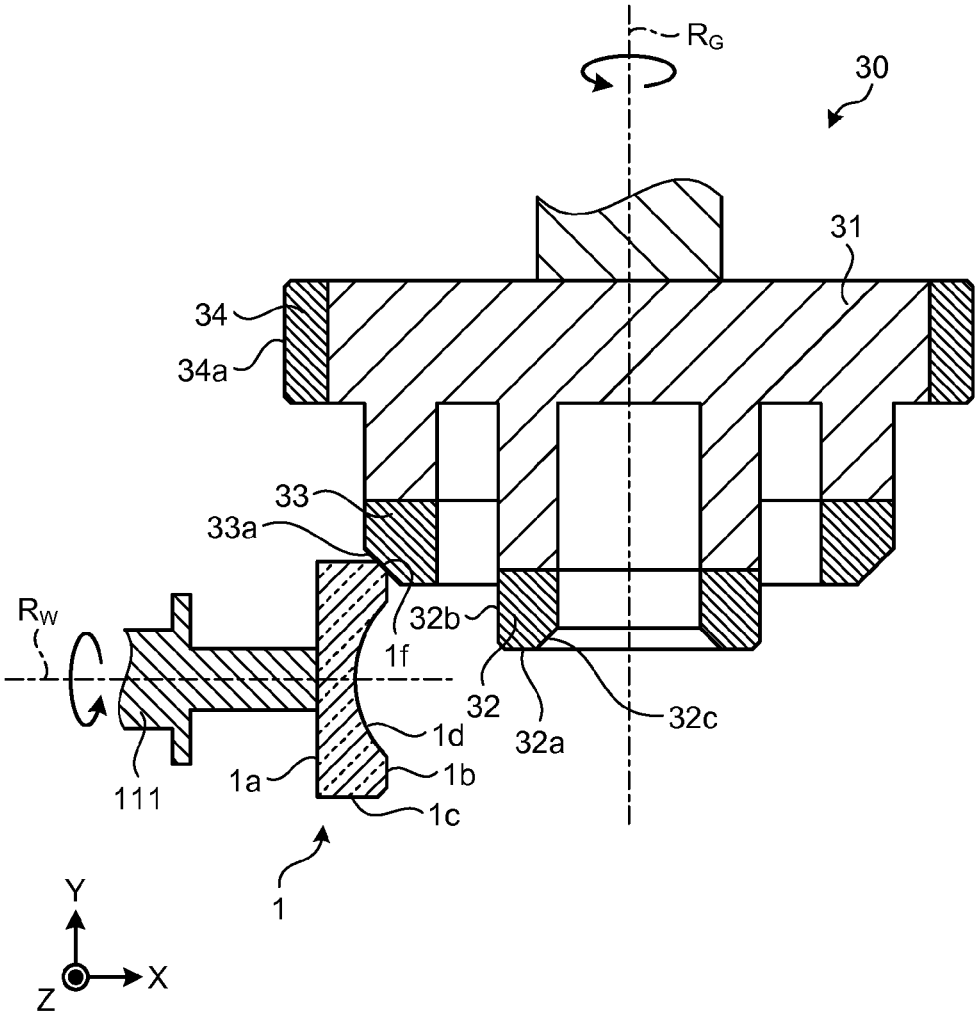
FIG. 11 is an XY sectional view illustrating chamfering in a method for lens processing according to the second embodiment of the present invention.
Figure 12:
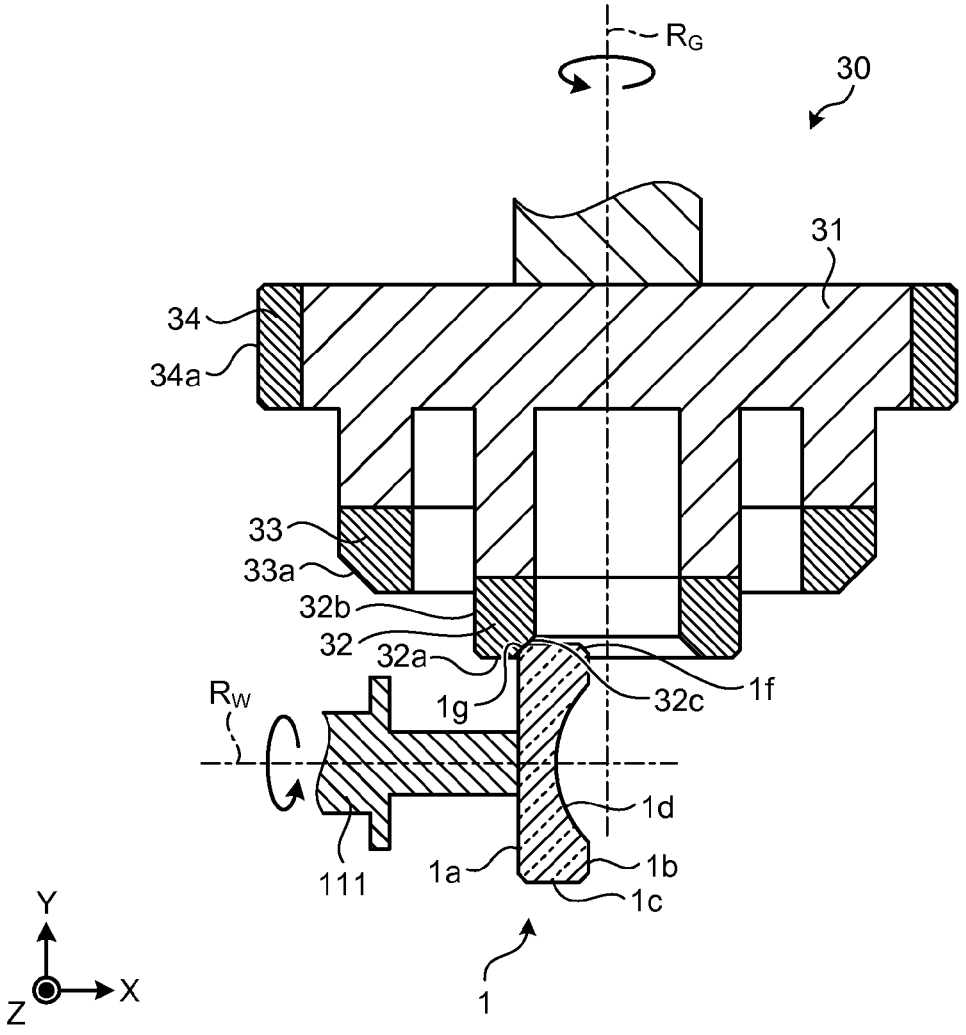
FIG. 12 is an XY sectional view illustrating the chamfering in the method for lens processing according to the second embodiment of the present invention.

FIGS. 11 and 12 are XY sectional views illustrating chamfering processing performed on the workpiece 1. As illustrated FIG. 11, in a case where the chamfering processing is performed on a lens surface 1*b*, which is nearer to the rotation axis $R_G$, the workpiece 1 and the grinding tool 30 are rotated by driving the rotation motors 115 and 122, and an outer periphery end portion 1*f* of the lens surface 1*b* is abutted on the inclined grinding surface 33*a* of the grindstone 33. Accordingly, the chamfering is performed on the outer periphery end portion 1*f*.

As illustrated in FIG. 12, in a case where the chamfering is performed on a lens surface 1*a*, which is on a side far from the rotation axis $R_G$, the workpiece 1 and the grinding tool 30 are rotated by driving the rotation motors 115 and 122, and an outer periphery end portion 1*g* of the lens surface 1*a* is abutted on the inclined grinding surface 32*c* of the grindstone 32. Accordingly, the chamfering is performed on the outer periphery end portion 1*g*.

Figure 13:
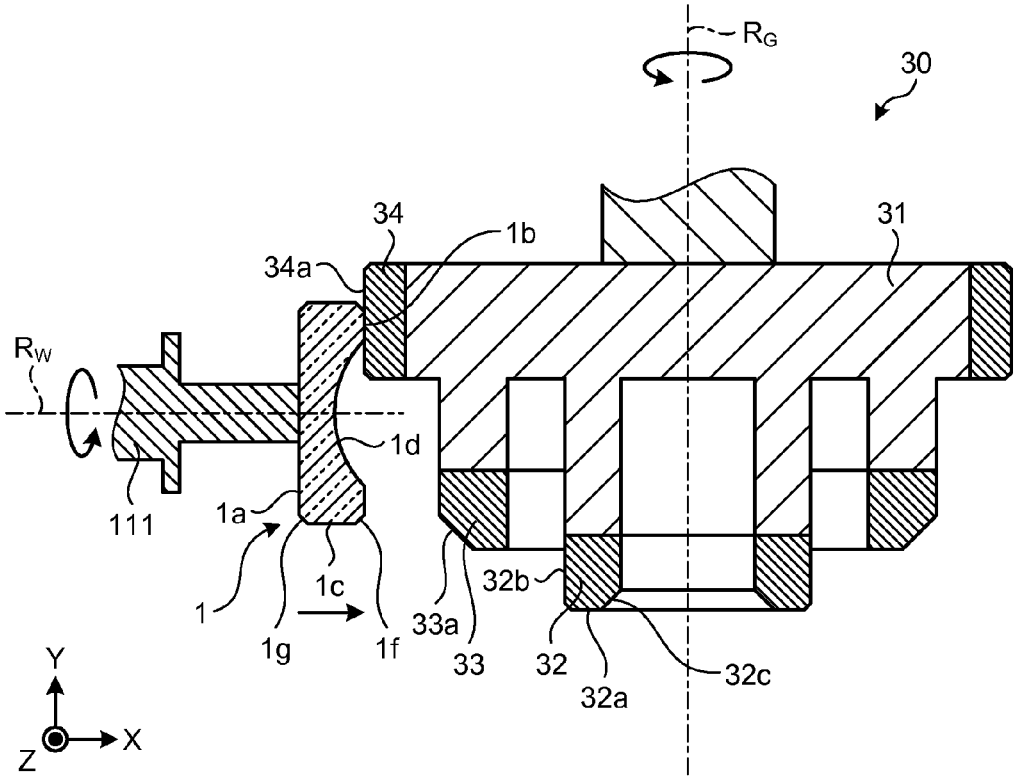
FIG. 13 is an XY sectional view illustrating end face processing in the method for lens processing according to the second embodiment of the present invention.

FIG. 13 is an XY sectional view illustrating end face processing performed on the workpiece 1. As illustrated in FIG. 13, in a case where the lens surface 1*b* is ground in a planar shape, the workpiece 1 and the grinding tool 30 are rotated by driving the rotation motors 115 and 122, and a region to be ground of the lens surface 1*b* is abutted on the outer periphery grinding surface 34*a* of the grindstone 34. Then, by moving the workpiece 1 to a desired coordinate in the positive X direction, the lens surface 1*b* is ground until a desired thickness is reached.

As described above, according to the second embodiment, by using the grinding tool 30, various processing such as the centering and edging processing, the D-cut processing, the chamfering, and the end face processing can be performed by one lens processing apparatus. Thus, it is possible to reduce a moving distance of the workpiece 1 in a case where such processing is performed, whereby a cycle time may be reduced.

In the above-described first and second embodiments, a relative position of the workpiece 1 to the grinding tool 10 is controlled by fixing a position of the grinding wheel spindle 120 and by moving the workpiece shaft 110 within an XY plane. In contrast, it is also possible to fix a position of the workpiece shaft 110 and move the grinding wheel spindle 120 within the XY plane. It is also possible to move both of the workpiece shaft 110 and the grinding wheel spindle 120 relatively to each other.

According to some embodiments, a rotation axis of an optical member is orthogonal to a rotation axis of a ring-shaped grinding tool, and an end face of the grinding tool is used as a grinding surface. With this structure, it is possible to accurately perform a plurality of processing steps including centering and edging processing and so-called D-cut processing, by a single apparatus without causing complication of the apparatus or complication and prolongation of work.

The above described first and second embodiments and the modification are mere examples for carrying out the present invention, and these do not intend to limit the present invention. In addition, the present invention may form a variety of inventions by combining as appropriate a plurality of constituent elements disclosed in the first and second embodiments and the modification. The present invention may be changed in a variety of ways according to specifications and the like, and various other embodiments may be possible within a scope of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A lens processing apparatus comprising:

an optical member holding unit configured to hold an optical member as a processing target, the optical member holding unit being rotatable around a first rotation axis;

a first driving unit configured to rotate the optical member holding unit;

a ring-shaped grinding tool having an annular planar grinding surface that is an end face of the grinding tool, and having an outer periphery grinding surface that is an outer periphery of the grinding tool;

a grinding tool holding unit configured to coaxially hold the grinding tool, the grinding tool holding unit being rotatable around a second rotation axis orthogonal to the first rotation axis;

a second driving unit configured to rotate the grinding tool holding unit;

a moving unit configured to move at least one of the optical member and the grinding tool relative to the other; and a control unit configured to control relative movement between the optical member and the grinding tool by the moving unit and rotation of the optical member and the grinding tool by the first and second driving units, wherein the control unit is configured to cause at least one of the optical member and the grinding tool to move relative to the other along the first rotation axis and to cause the outer periphery grinding surface to grind the optical member along the first rotation axis, thereby forming a planar D-cut surface, and to cause the planar grinding surface to further planarize the D-cut surface while rotating only the grinding tool.

2. A lens processing apparatus comprising:

an optical member holding unit configured to hold an optical member as a processing target having an outer periphery, the optical member holding unit being rotatable around a first rotation axis;

a first driving unit configured to rotate the optical member holding unit;

a ring-shaped grinding tool having an annular planar grinding surface that is an end face of the grinding tool, a length in a radial direction of the planar grinding surface being longer than a length in an optical axis direction of the outer periphery of the optical member;

a grinding tool holding unit configured to coaxially hold the grinding tool, the grinding tool holding unit being rotatable around a second rotation axis orthogonal to the first rotation axis;

a second driving unit configured to rotate the grinding tool holding unit;

a moving unit configured to move at least one of the optical member and the grinding tool relative to the other; and a control unit configured to control relative movement between the optical member and the grinding tool by the moving unit and rotation of the optical member and the grinding tool by the first and second driving units, wherein the control unit is configured to cause the outer periphery of the optical member to abut on the end face of the grinding tool and to cause at least one of the optical member and the grinding tool to move relative to the other along the second rotation axis while rotating only the grinding tool to grind a part of the outer periphery in a planar shape.

3. A method for lens processing comprising:

holding an optical member as a processing target such that an optical axis of the optical member is orthogonal to a central axis of a ring-shaped grinding tool, the grinding tool having an annular planar grinding surface that is an end face of the grinding tool and having an outer periphery grinding surface that is an outer periphery of the grinding tool; and grinding the optical member by causing at least one of the optical member and the grinding tool to move relative to the other along the optical axis, causing the outer periphery grinding surface to grind the optical member along the optical axis, thereby forming a planar D-cut surface, and causing the planar grinding surface to further planarize the D-cut surface while rotating only the grinding tool around the central axis.

4. A method for lens processing comprising:

holding an optical member as a processing target having an outer periphery such that an optical axis of the optical member is orthogonal to a central axis of a ring-shaped grinding tool, the grinding tool having an annular planar grinding surface that is an end face of the grinding tool, a length in a radial direction of the planar grinding surface being longer than a length in an optical axis direction of the outer periphery of the optical member; and grinding the optical member by causing the optical member to abut on the end face of the grinding tool while rotating at least the grinding tool around the central axis, wherein the grinding of the optical member includes causing the outer periphery of the optical member to abut on the end face of the grinding tool and causing at least one of the optical member and the grinding tool to move relative to the other along the central axis while rotating only the grinding tool to grind a part of the outer periphery in a planar shape.

* * * * *